US010525605B2

(12) United States Patent
Scimone et al.

(10) Patent No.: US 10,525,605 B2
(45) Date of Patent: Jan. 7, 2020

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); John Swain, San Jose, CA (US)

(73) Assignee: Slice, Inc., San Jose, CA (US)

( * ) Notice: Subject to any disclaimer, the term of this patent is extended or adjusted under 35 U.S.C. 154(b) by 84 days.

(21) Appl. No.: 15/863,572

(22) Filed: Jan. 5, 2018

(65) Prior Publication Data

US 2018/0290315 A1 Oct. 11, 2018

Related U.S. Application Data

(60) Provisional application No. 62/482,539, filed on Apr. 6, 2017.

(51) Int. Cl.
*B26B 5/00* (2006.01)
*B26B 29/02* (2006.01)
*B25G 1/10* (2006.01)

(52) U.S. Cl.
CPC ..... *B26B 5/00* (2013.01); *B25G 1/10* (2013.01); *B26B 29/025* (2013.01)

(58) Field of Classification Search
CPC ..... B26B 5/00; B26B 29/025; B25G 1/10
See application file for complete search history.

(56) References Cited

U.S. PATENT DOCUMENTS 2,968,489 A * 1/1961 Doniger ..... B26B 5/00 279/48
6,569,175 B1 * 5/2003 Robinson ..... A61B 17/3213 30/286
2006/0130338 A1 * 6/2006 Dzubak ..... B26B 5/003 30/162
2009/0216258 A1 * 8/2009 Geuder ..... A61B 17/3211 606/170
2010/0137894 A1 * 6/2010 Ueno ..... A61B 17/3211 606/167
2010/0146799 A1 * 6/2010 Hoffman ..... A61B 17/3211 30/286
2014/0165409 A1 * 6/2014 Scimone ..... B26B 5/003 30/162
2018/0290315 A1 * 10/2018 Scimone ..... B26B 5/00

* cited by examiner

*Primary Examiner* — Hwei-Siu C Payer
(74) *Attorney, Agent, or Firm* — Ellenoff Grossman & Schole LLP; James M. Smedley; Alex Korona

(57) ABSTRACT

A cutting device is disclosed. The cutting device has a body member, a cutting member that is removably attachable to the body member, and a cover member that is movably disposed on the body member, the cover member including a protrusion. The body member has a recess configured to receive the protrusion. The recess includes a first portion extending in a first direction and a second portion extending in a second direction that is different from the first direction.

14 Claims, 8 Drawing Sheets

CUTTING DEVICE

RELATED APPLICATIONS

This application claims the benefit of U.S. Provisional Patent Application Ser. No. 62/482,539 filed Apr. 6, 2017, which is hereby incorporated by reference in its entirety.

TECHNICAL FIELD

The present disclosure generally relates to a cutting device, and more particularly to a cutting device having a movable cover member.

BACKGROUND

Craft knives such as pen cutters are familiar tools to many people due to their convenient size and ease of use. Typical pen cutters have the shape and dimensions of a pen, e.g. a generally straight "handle", with a short blade at its tip. Unlike e.g. carving knives, craft knives are intended for shorter duration of use, to cut various materials such as sheets of paper, felt, or plastic, e.g. for various craft projects. Many pen cutters come with a detachable safety cap that covers the blade when the pen cutter is not in use. This creates a hazardous situation in two instances. First, when the pen cutter is temporarily being set aside for brief periods during a longer project, the blade remains exposed as it is inconvenient to replace the cap each time the cutter is used. Second, the fact that many pen cutters have a detachable cap means that the cap typically becomes separated from the pen cutter itself during use, and is thus easily lost. Both situations temporarily or permanently leave a pen cutter with an exposed blade, and an increased risk for accidental cuts and injuries to materials, objects or persons results.

Therefore, there is a need in the art for a craft knife with increased safety functionality that is easy to use and that prevents the blade from being unnecessarily exposed. The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a body member, a cutting member that is removably attachable to the body member, and a cover member that is movably disposed on the body member, the cover member including a protrusion. The body member includes a recess configured to receive the protrusion. The recess includes a first portion extending in a first direction and a second portion extending in a second direction that is different from the first direction.

In another aspect, the present disclosure is directed to a method. The method includes removably attaching a cutting member to a body member. The method also includes moving a cover member in a first direction along a length of the body member between a first position covering the cutting member and a second position uncovering the cutting member. The method further includes moving the cover member in a second direction that is different from the first direction at the first position or the second position.

DETAILED DESCRIPTION AND INDUSTRIAL APPLICABILITY

Figure 1:
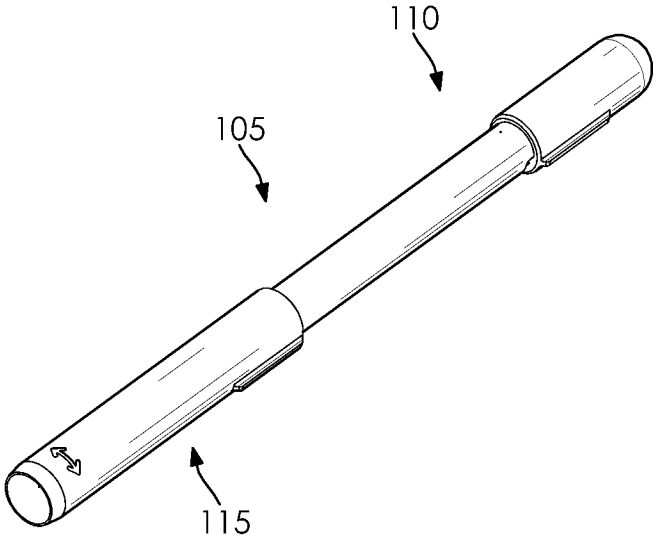
FIG. 1 is a perspective view of an exemplary cutting device in accordance with an embodiment of the present invention.
Figure 2:
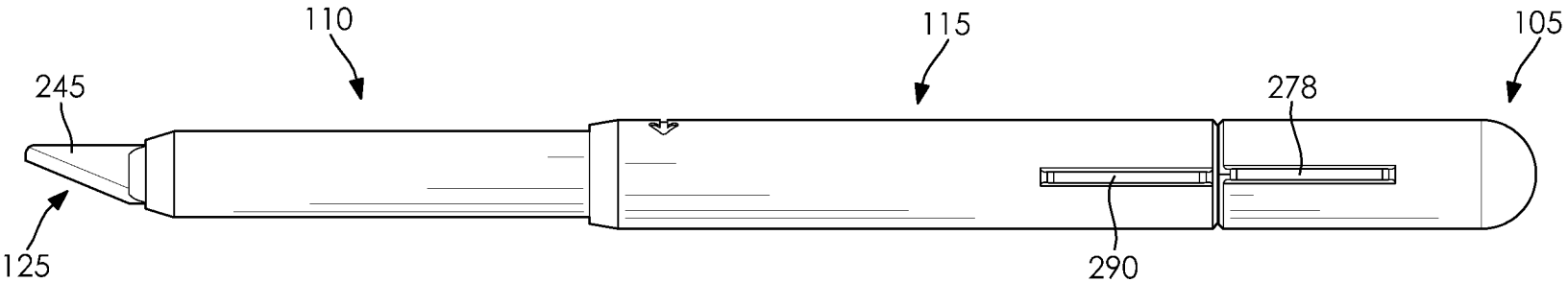
FIG. 2 is a side view of an exemplary cutting device in accordance with an embodiment of the present invention.
Figure 3:
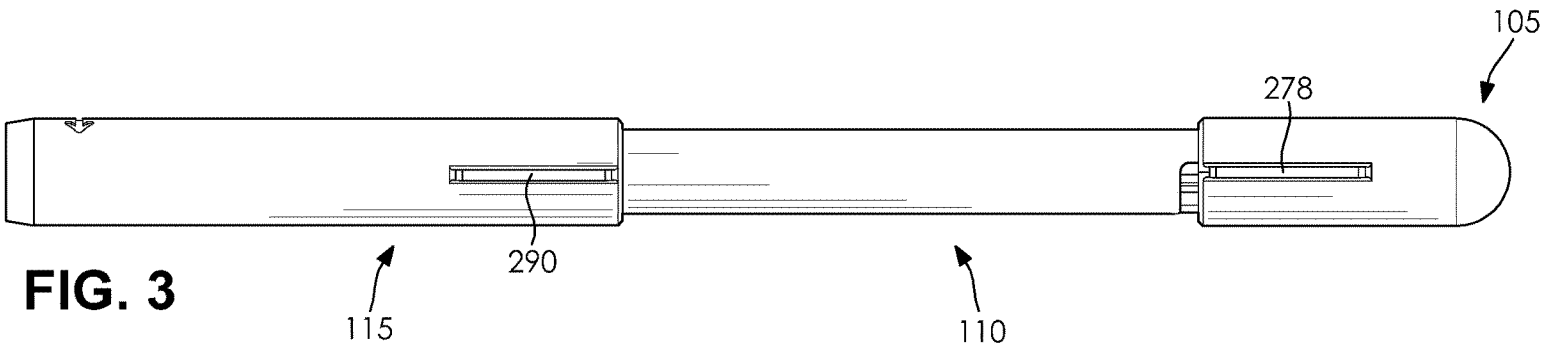
FIG. 3 is a side view of an exemplary cutting device in accordance with an embodiment of the present invention.
Figure 4:
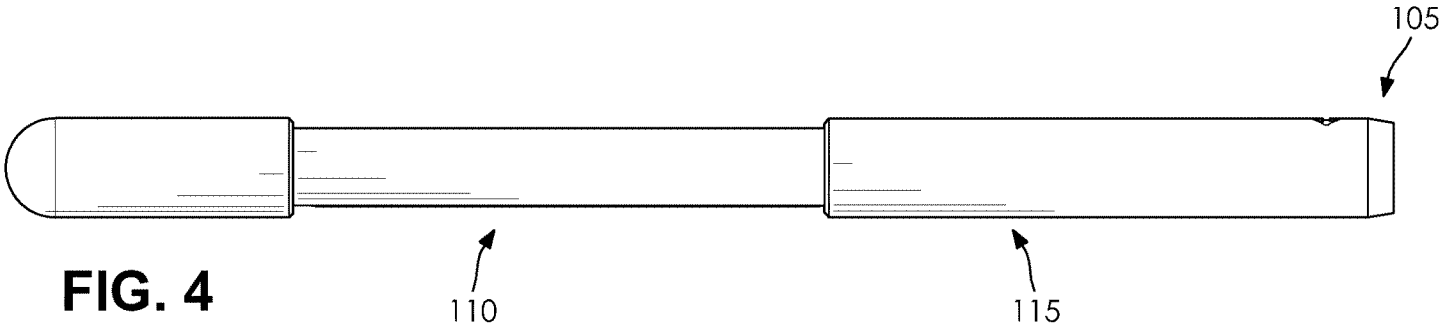
FIG. 4 is a side view of an exemplary cutting device in accordance with an embodiment of the present invention.
Figure 5:
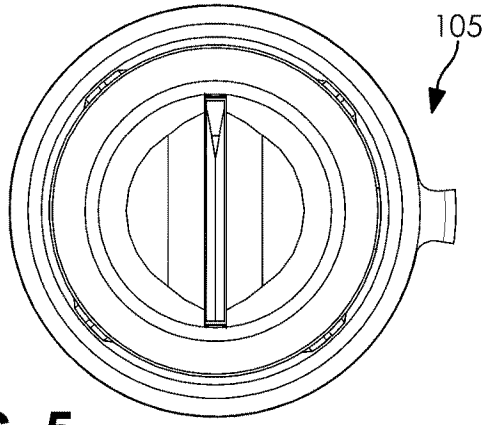
FIG. 5 is a front view of an exemplary cutting device in accordance with an embodiment of the present invention.
Figure 6:
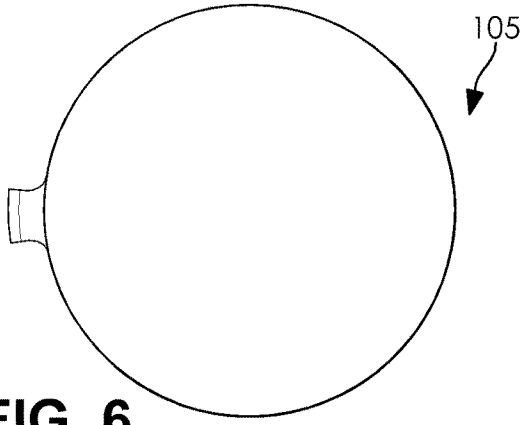
FIG. 6 is a back view of an exemplary cutting device in accordance with an embodiment of the present invention.

FIGS. 1-6 illustrate an exemplary cutting device 105. The exemplary cutting device disclosed herein may be any suitable device for cutting material such as, for example, a craft knife, a seam ripper, a box cutter, a utility knife, or a precision knife. For example, cutting device 105 may be a craft knife such as a pen cutter or similar cutting device. For example, FIG. 1 illustrates a perspective view of exemplary cutting device 105, FIGS. 2-4 illustrate side views of exemplary cutting device 105, FIG. 5 illustrates a front view of exemplary cutting device 105, and FIG. 6 illustrates a rear view of exemplary cutting device 105.

Cutting device 105 may include a body assembly 110 and a cover member 115. Cover member 115 may be movably disposed on body assembly 110.

The exemplary cutting device may be constructed from any suitable variety of durable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, body assembly 110 and/or cover member 115 may be formed partially or substantially entirely from plastic, plastic composite, wood, metal, metal alloy materials, and/or polymers. For example, body assembly 110 and/or cover member 115 may be plastic or metal structural members. One or more weights included in body assembly 110, described further below, may be formed for example from relatively dense material such as metal material. As described further below, body assembly 110 and/or cover member 115 may include components formed from plastic, plastic composite, metal, and/or metal alloy materials and components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic. For example, cutting device 105 may include any suitable materials for use in a cutting device such as, e.g., a seam ripper, a box cutter, a utility knife, or a precision knife.

Body assembly 110 and/or cover member 115 may provide, for example, a handle for cutting device 105 for use by a user. For example, body assembly 110 and/or cover member 115 may act as craft knife handle (e.g., a pen cutter handle), a seam ripper handle, or a handle of a box cutter, utility knife, or precision knife. For example, cover member 115 may act as a substantially hollow housing configured to receive portions of body assembly 110 as well as additional components such as the exemplary components described herein. For example, body assembly 110 and/or cover member 115 may have a substantially circular cylindrical shape. Also for example, body assembly 110 and/or cover member 115 may be any other suitable shape such as, for example, circular cylindrical, elliptic cylindrical, octagonal cylindrical, rectangular cylindrical, and/or a substantially regular tube shape, e.g., a square, triangular, hexagonal, and/or octagonal shape.

Figure 7:
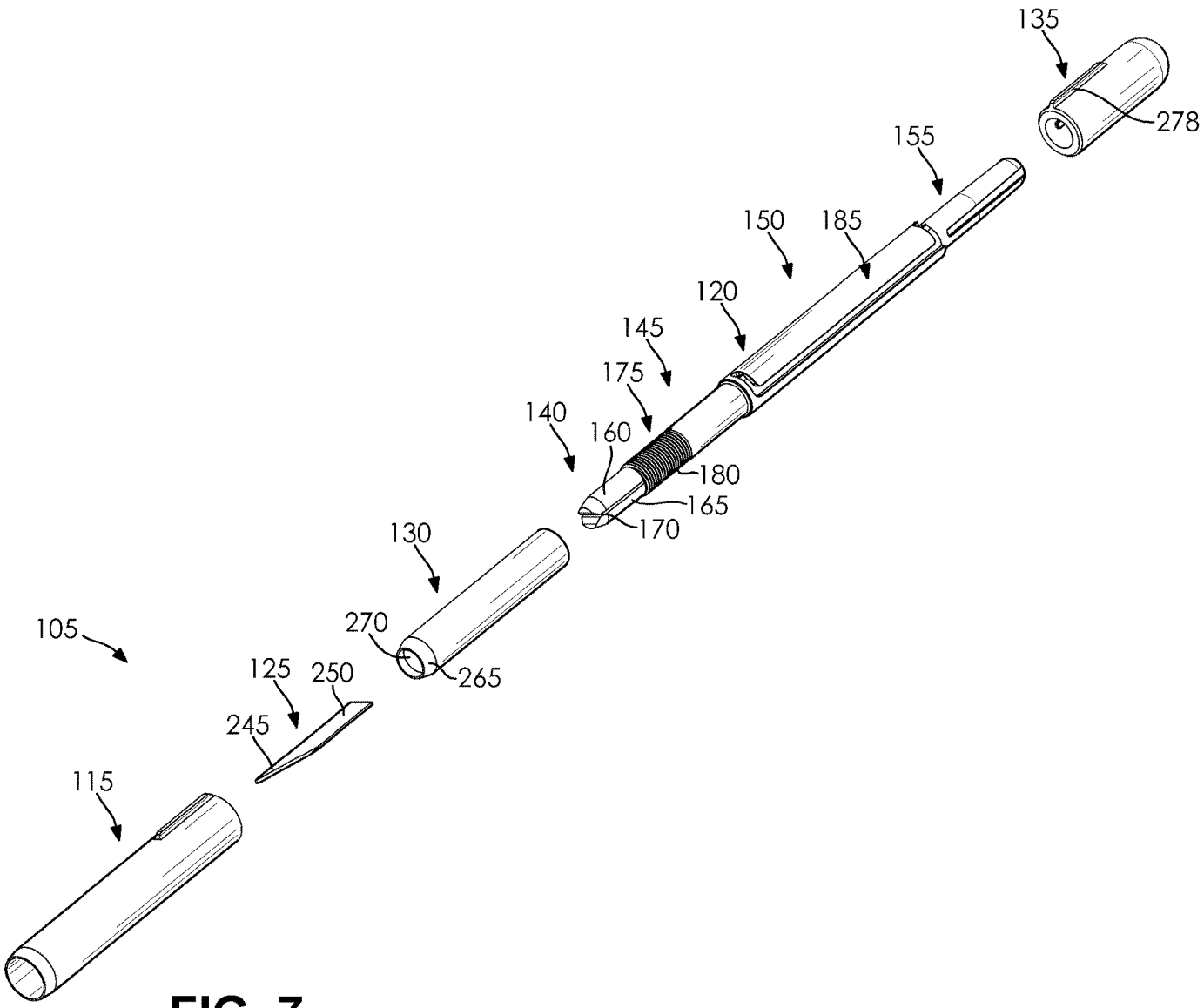
FIG. 7 is an exploded view of an exemplary cutting device in accordance with an embodiment of the present invention.
Figures 8, 9:
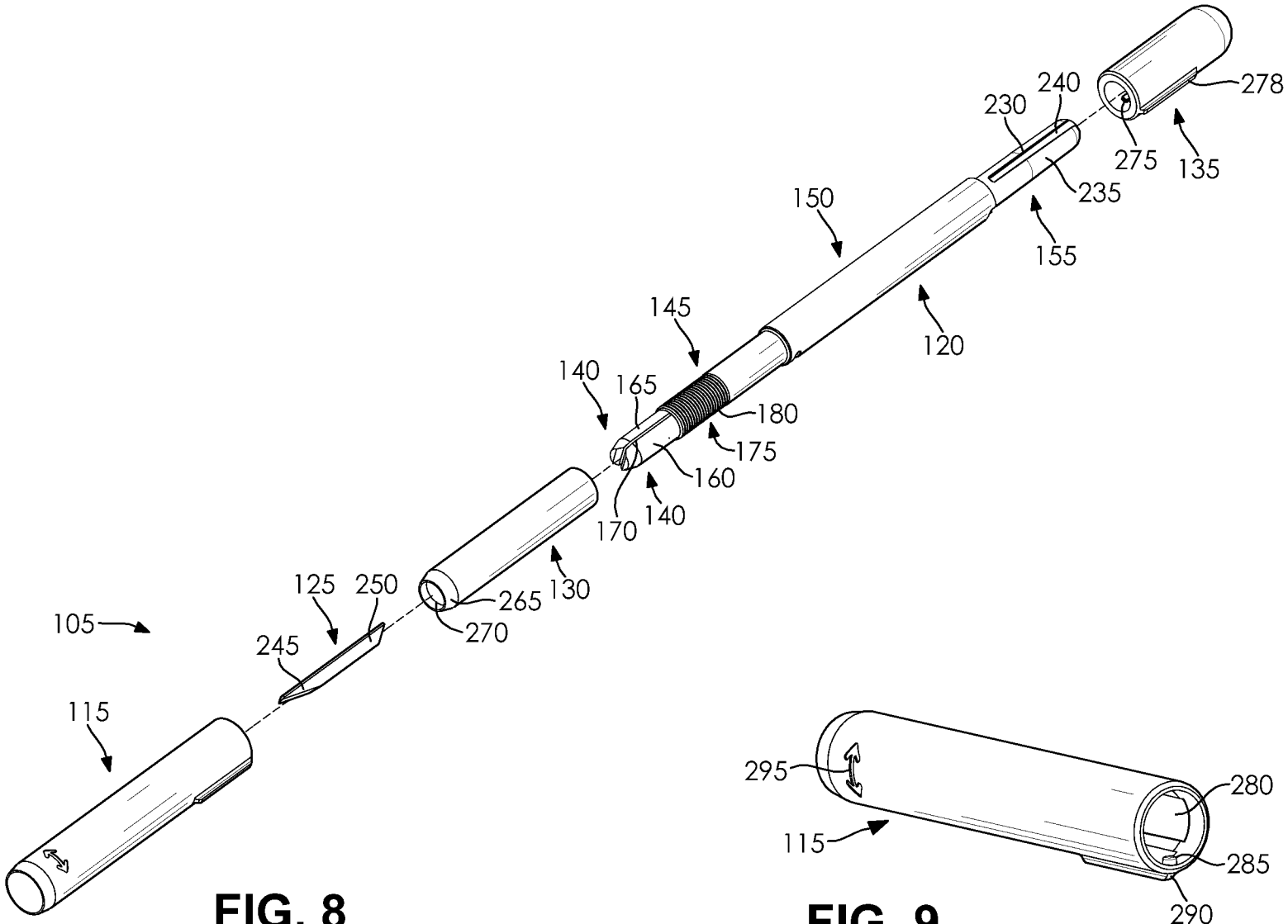
FIG. 8 is an exploded view of an exemplary cutting device in accordance with an embodiment of the present invention.
FIG. 9 is a perspective view of an exemplary cutting device in accordance with an embodiment of the present invention.

As illustrated in FIGS. 7 and 8, body assembly 110 may include a body member 120, a cutting member 125, a member 130, and a rear member 135. Cutting member 125 may be removably attachable to body member 120, and member 130 may be attached to body member 120. Rear member 135 may be attachable (e.g., removably attachable or attached in a fixed manner) to body member 120.

Figure 10:
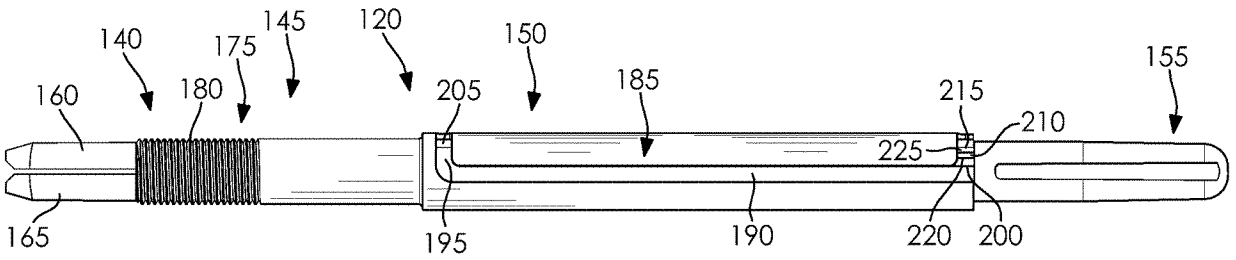
FIG. 10 is a side view of a component of an exemplary cutting device in accordance with an embodiment of the present invention.

As illustrated in FIG. 10, body member 120 may include an attachment portion 140, an attachment portion 145, an attachment portion 150, and an attachment portion 155. Attachment portions 140, 145, 150, and 155 may be used to attach components of cutting device 105 to body member 120 as disclosed for example herein. Body member 120 may be for example a substantially solid member, substantially hollow member, or member having both substantially solid and hollow portions.

As illustrated in FIGS. 7 and 8, attachment portion 140 may be disposed at an end portion of body member 120. Attachment portion 140 may include a member 160 and a member 165 that may extend from attachment portion 145. For example, members 160 and 165 may be integral with other portions of body member 120 (e.g., integral with attachment portion 145) and/or attached to other portions of body member 120 (e.g., attached to attachment portion 145). Members 160 and 165 may be disposed (for example disposed parallel to each other) so that a cavity 170 is formed between members 160 and 165. As disclosed for example herein, a portion of cutting member 125 may be received in cavity 170 between members 160 and 165 so that cutting member 125 is removably attachable to attachment portion 140. For example, members 160 and/or 165 may include protrusions (e.g., or recesses) on a surface facing (e.g., forming) cavity 170 that may be received by corresponding apertures (e.g., or recesses) disposed on cutting member 125 so that cutting member 125 is removably attachable to attachment portion 140 of body member 120.

As illustrated in FIGS. 7, 8, and 10, attachment portion 145 may be disposed between attachment portions 140 and 150. For example, attachment portion 145 may be integral with other portions of body member 120 (e.g., integral with attachment portions 140 and/or 150) and/or attached to other portions of body member 120 (e.g., attached to attachment portions 140 and/or 150). Attachment portion 145 may include an attachment section 175 to which member 130 may be attached (e.g., removably or substantially fixedly attached). Attachment section 175 may be any suitable attachment device for attaching (e.g., removably or substantially fixedly attaching) member 130 to attachment portion 145. For example, attachment section 175 may include a threaded fastener, a friction-fit attachment device, a snap-fit attachment device, an adhesive attachment device, a hook and loop system fastener, and/or any suitable mechanical fastener. For example, attachment section 175 may be a threaded fastener having a plurality of connectors 180 that may be for example threads. For example as disclosed herein, connectors 180 may be received by corresponding connectors disposed on an interior surface of member 130.

As illustrated in FIGS. 7, 8, and 10, attachment portion 150 may be disposed between attachment portions 145 and 155. For example, attachment portion 150 may be integral with other portions of body member 120 (e.g., integral with attachment portions 145 and/or 155) and/or attached to other portions of body member 120 (e.g., attached to attachment portions 145 and/or 155). Attachment portion 150 may include a recess 185. Recess 185 may include an aperture, hole, groove, channel, slot, cavity, and/or any other suitable recess for receiving a portion of cover member 115 as disclosed for example herein. For example, recess 185 may be any suitable recess to allow a portion of cover member 115 to fit into and slide within (e.g., and be guided by) recess 185 to allow cover member 115 to move along body member 120 (e.g., to allow cover member 115 to slide along a longitudinal axis of body member 120 and/or to rotate about body member 120). For example, one or more portions of recess 185 may be about 1-2 mm wide and about 0.5-5 mm deep, e.g., about 1.1, 1.2, 1.3 or 1.5 mm or more wide, and e.g. about 1-1.5 mm, 1.5-2 mm, or about 2-3 mm deep. A depth of recess 185 may for example vary, with portions of recess 185 being an additional 0.25-2 mm deep (e.g., an additional 0.5-1.5 mm deep). Recess 185 may be formed depending on a method of manufacture of body member 120, e.g. by additive or reductive manufacturing (e.g., machining) or by suitably configuring a mold (e.g. with a raised "negative" of recess 185 prior to injection molding). For example, when body member 120 is a substantially or partially solid member, recess 185 may be a channel or groove formed in a surface portion of attachment portion 150. Also for example, if body member 120 is substantially or partially hollow (e.g. a hollow housing such as for example a hollow cylinder), then depending on a thickness of an exterior wall of attachment portion 150, recess 185 may be a surface channel and/or an opening in the exterior wall of attachment portion 150. Body member 120 may be formed with recess 185 during manufacturing. Also for example, body member 120 may be manufactured without recess 185, and then recess 185 may be formed after body member 120 is manufactured (e.g., formed by removing material from body member 120 using suitable tools or techniques such as by carving, drilling, piercing, grooving, grinding, and/or machining, depending for example on the material of body member 120). It is also contemplated that some or all of recess 185 may be formed at other portions of body member 120 (e.g., attachment portions 140, 145, and/or 155 and/or cover member 115, member 130, or rear member 135).

Recess 185 may have any suitable configuration for receiving and/or guiding a portion of cover member 115. For example, recess 185 may have any suitable configuration shape, number of portions, width, length, and depth, which may for example vary at various portions of recess 185. The exemplary embodiments disclosed herein illustrate a number of examples of the many configurations of recess 185 that may be provided on body member 120. For example, portions of recess 185 may be part of an integral recess 185 (e.g., recess 185 may be a continuous recess) or one or more portions of recess 185 may be located separately from other portions of recess 185 (e.g., recess 185 may be a discontinuous recess having portions that are separate and not continuous with other portions of recess 185).

For example as illustrated in FIG. 10, recess 185 may have a portion 190, a portion 195, and a portion 200. For example, portion 190 may extend in a first direction and portions 195 and 200 may extend in a second direction that is different from the first direction. For example, portion 190 may extend in a first direction that is a longitudinal direction extending along a length of body member 120 and/or cutting device 105. For example, portion 190 may extend in a first direction that is substantially perpendicular (or e.g., at an angle from such as at an angle between 45 degrees and 90 degrees or perpendicular, between 30 degrees and 60 degrees, between 15 degrees and 75 degrees, and/or any suitable angle). Also for example, portions 195 and 200 may extend in a substantially radial direction extending radially about a longitudinal centerline of body member 120 and/or cutting device 105. For example, recess 185 may include a first portion (e.g., portion 190) extending in a first direction and a second portion (e.g., portion 195 and/or 200) extending in a second direction that is different from the first direction. Also for example, cover member 115 may be movably disposed on the body member (e.g., body assembly 110) between a first position covering exemplary cutting member 125 and a second position uncovering exemplary cutting member 125. Also for example, the first direction may be substantially perpendicular to the second direction. Further for example, the first direction may be a longitudinal direction extending along a length of cutting device 105. Also for example, the second direction may be a radial direction extending radially about a longitudinal centerline of cutting device 105. Additionally for example, recess 185 may include a third portion (e.g., portions 195 and/or 200) extending in the second direction, wherein the first portion (e.g., portion 190) may be disposed between the second portion and the third portion.

Portions of recess 185 may for example include protrusions. For example, portions 190, 195, and/or 200 may include protrusions disposed within recess 185. For example, a protrusion 205 may be disposed within portion 195 and a protrusion 210 may be disposed within portion 200. For example, protrusion 205 may be disposed at any location of portion 195 such as a central portion of portion 195. Also for example, protrusion 210 may be disposed at any location of portion 200 such as a central portion of portion 200. Protrusions 205 and 210 may for example be raised portions of recess 185 that may not be as deep as other portions of recess 185. Protrusions 205 and 210 may for example each have a raised central portion 225 with sloped surfaces 215 and 220 on either side. For example, portions 205 and 210 may each be two-sided ramps with sloped surfaces 215 and 220 leading up from recess 185 to either side of central portion 225. For example, central portion 225 may be a crown having a flat, rounded, or angular top (e.g., apex), with surfaces 215 and 220 leading up on either side to central portion 225.

As illustrated in FIGS. 7 and 8, attachment portion 155 may be disposed at an end portion of body member 120. For example, attachment portion 155 may be disposed on an opposite end of body member 120 as attachment portion 140. For example, attachment portion 155 may be integral with other portions of body member 120 (e.g., integral with attachment portion 150) and/or attached to other portions of body member 120 (e.g., attached to attachment portion 150). Attachment portion 155 may include a member 230 and a member 235 that may for example be disposed parallel to each other, so that a cavity 240 is formed between members 230 and 235. Also for example, members 230 and 235 may be integrally formed and cavity 240 may be an elongated aperture (e.g., groove) formed on attachment portion 155. As disclosed for example herein, a portion of rear member 135 may be received in cavity 240 between members 230 and 235 so that rear member 135 is attachable (e.g., removably attachable or substantially fixedly attached) to attachment portion 155. Also for example, members 230 and/or 235 may include protrusions (e.g., or recesses) on a surface facing (e.g., forming) cavity 240 that may be received by corresponding apertures (e.g., or recesses) disposed on portions of rear member 135 so that rear member 135 is attachable (e.g., removably attachable or substantially fixedly attached) to attachment portion 155 of body member 120.

Figure 11:
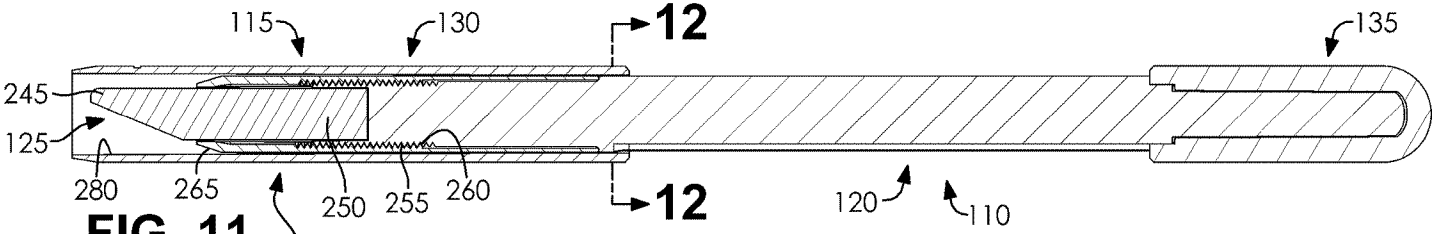
FIG. 11 is a sectional view of an exemplary cutting device in accordance with an embodiment of the present invention.

As illustrated in FIGS. 7, 8, and 11, cutting member 125 of cutting device 105 may be any suitable blade or cutter for cutting of a material by cutting device 105. For example, cutting member 125 may be formed from a ceramic material that is capable of withstanding extended use before becoming dull or unusable. For example, cutting member 125 may be a ceramic blade. For example, cutting member 125 may include ceramic materials such as Zirconium Oxide or any other suitable ceramic materials for use in a blade. For example, cutting member 125 may be a ceramic blade that may be an angled and/or hooked blade formed from Zirconium Oxide. Alternatively for example, cutting member 125 may be a metal blade or a blade formed from any suitable material than can be used for cutting materials. Cutting member 125 may include rounded tips to reduce the chance of a user being cut unintentionally by cutting member 125.

Cutting member 125 may include a portion 245 that may be used for cutting material. Portion 245 may be a relatively narrow portion (e.g., narrower relative the other portions of cutting member 125) of cutting member 125 that may serve to cut material. Cutting member 125 may also include a portion 250 that may be received in cavity 170 between members 160 and 165 of attachment portion 140 so that cutting member 125 is removably attachable to attachment portion 140. For example, portion 250 of cutting member 125 may include protrusions (e.g., or recesses) on surface facing members 160 and/or 165 that may be received by corresponding apertures (e.g., or recesses) disposed on cutting member 125 so that cutting member 125 is removably attachable to attachment portion 140 of body member 120. For example, cutting member 125 may be secured by attachment portion 140 in any suitable manner, for example by friction fit, use of adhesive, a designated blade receptacle (e.g., cavity 170), or any combination thereof. For example, cutting member 125 may be secured by a friction-fit formed between members 160 and/or 165 and portion 250 of cutting member 125 when cutting member 125 is received within cavity 170. For example as illustrated in FIG. 11, when cutting member 125 is placed inside member 130 and attached to attachment portion 140 (e.g., serving as a blade receptacle), cutting member 125 may be secured in such a manner as to substantially prevent cutting member 125 from becoming dislodged or otherwise falling out cutting device 105. Also for example, adhesive may be additionally used to secure cutting member 125 to attachment portion 140.

As illustrated in FIGS. 7, 8, and 11, member 130 of cutting device 105 may be attached to attachment portion 145 of body member 120. Member 130 may be for example a substantially or partially hollow member. Member 130 may include an attachment section 255 that can be attached (e.g., removably or substantially fixedly attached) to attachment section 175 of attachment portion 145. Attachment section 255 may be any suitable attachment device for attaching (e.g., removably or substantially fixedly attaching) member 130 to attachment portion 145. Attachment section 255 may be for example disposed on an interior surface of member 130. For example, attachment section 255 may include a threaded fastener, a friction-fit attachment device, a snap-fit attachment device, an adhesive attachment device, a hook and loop system fastener, and/or any suitable mechanical fastener. For example, attachment section 255 may be a threaded fastener having a plurality of connectors 260 that may be for example threads. For example as disclosed herein, connectors 260 may be received by corresponding connectors 180 of attachment portion 145 of body member 120.

Member 130 may have a portion 265 disposed at an end portion of member 130 forming an aperture 270. As illustrated in FIGS. 7, 8, and 11, cutting member 125 may be inserted into aperture 270 of member 130 to be attached to attachment portion 140. As illustrated in FIG. 11, an interior surface of portion 265 may help to support cutting member 125 when disposed within member 130. Member 130 may thereby, together with attachment portion 140, help to secure cutting member 125 within cutting device 105. Also for example, adhesive may be used to attach member 130 to attachment portion 145 (e.g., to attach attachment section 255 to attachment section 175). It is also contemplated that cutting member 125 may be shaped so that portion 265 may lock cutting member 125 in place on cutting device 105 when member 130 is fixed (e.g., threaded onto) attachment portion 145. For example, it is contemplated that member 130 may be removably attached to attachment portion 145 to selectively lock cutting member 125 to attachment portion 145 of body member 120.

As illustrated in FIGS. 7, 8, and 11, rear member 135 of cutting device 105 may be attached (e.g., removably or substantially fixedly attached) to attachment portion 155 of body member 120. Rear member 135 may be for example a substantially or partially hollow member. Rear member 135 may include an attachment portion 275 disposed at an interior surface of rear member 135 that can be received in cavity 240 of attachment portion 155. Attachment portion 275 may be for example a protrusion (e.g., an elongated protrusion) that can be received in cavity 240 that is a groove or an elongated, flat member that can be received between members 230 and 235 of attachment portion 155 when cavity 240 is an open cavity formed between members 230 and 235. Also for example, adhesive may be additionally used to attach rear member 135 to attachment portion 155. Rear member 135 may also be attached (e.g., removably or substantially fixedly attached) to attachment portion 155 by any other suitable technique such as a threaded fastener, a friction-fit attachment device, a snap-fit attachment device, an adhesive attachment device, a hook and loop system fastener, and/or any suitable mechanical fastener. Rear member 135 may also include a protrusion 278 that may be disposed on an exterior surface of rear member 135. Protrusion 278 may help a user of cutting device 105 to determine whether cover member 115 is in a locked or unlocked position as described further below (e.g., based on a movement such as a rotation of cover member 115 relative to body assembly 110).

Figure 12:
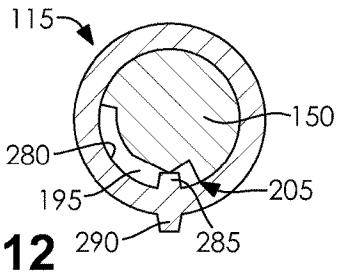
FIG. 12 is a sectional view of an exemplary cutting device in accordance with an embodiment of the present invention.
Figure 13:
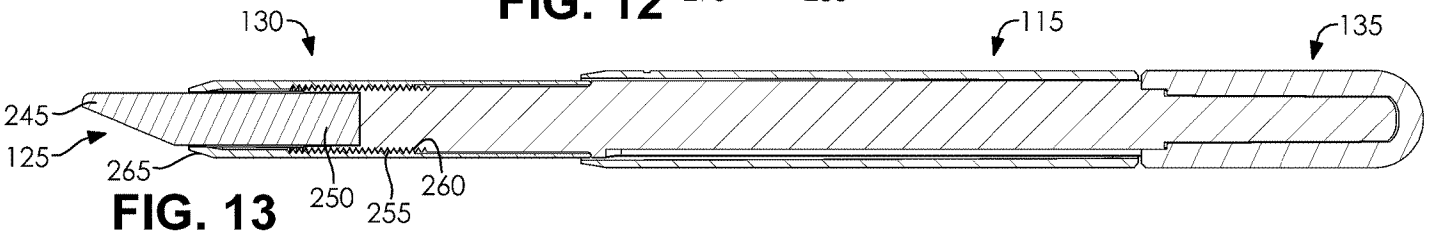
FIG. 13 is a sectional view of an exemplary cutting device in accordance with an embodiment of the present invention.

As illustrated in FIGS. 7, 8, and 11, cover member 115 may be movably disposed on body assembly 110 (e.g., movably disposed on body member 120 and member 130 of body assembly 110). Cover member 115 may be any suitable housing such as a substantially hollow or partially hollow member. For example, cover member 115 may be a cover (e.g., sheath) that is movably disposed on cutting device 105. For example, cover member 115 may encircle or surround a portion of body assembly 110. For example, cover member 115 may partially or completely circumferentially surround a portion of body assembly 110. For example, cover member 115 may be shaped so that an interior surface 280 of cover member 115 may fit (e.g., closely fit) contours of body assembly 110. For example, cover member 115 and/or body assembly 110 (e.g., member 130 and/or body member 120) may be shaped so that cover member 115 may slide (e.g., smoothly slide) over body assembly 110 between a first position covering cutting member 125 and a second position uncovering cutting member 125 (e.g., including any position between the first and second position). For example (e.g., as illustrated in FIGS. 11-13), cover member 115 may have an inner circumference (e.g., formed by interior surface 280) that may be configured to match or be slightly larger than an outer circumference of body assembly 110. For example, interior surface 280 of cover member 115 may substantially match a geometrical shape formed by exterior surfaces of body assembly 110 so that cover member 115 may move between the first and the second position. For example, cover member 115 may be a circular cylindrical cover member (e.g., sheath) that slidably covers body assembly 110 that may be a circular cylindrical body. Also for example, cover member 115 may be an elliptical cover member (e.g., sheath) that slidably covers body assembly 110 that may be an elliptical cylindrical body. Similarly for example, cover member 115 may be an octagonal shape or any other suitable shape that slidably covers body assembly 110 that may have an octagonal cylindrical body or any other suitably correspondingly-shaped body (e.g., correspondingly square-shaped or rectangular-shaped). Cover member 115 may be, for example, formed from a material that is transparent and/or translucent so that a location of cutting member 125 may be visible to a user of cutting device 105.

As illustrated in FIG. 9, cover member 115 may include a protrusion 285. Protrusion 285 may be any suitable protrusion or portion of material such as, for example, a flexible protrusion, a rigid protrusion, a pin, a locking pin, and/or a rocker. Protrusion 285 may be formed integrally with cover member 115 and may be a similar material as cover member 115 (e.g., of similar material as the material forming surface 280). Also for example, protrusion 285 may be attached to cover member 115 and may be formed from a similar or different material than cover member 115. Also for example, protrusion 285 may be provided as part of an insert piece that may be attached to surface 280. For example, as disclosed in the exemplary embodiments herein, protrusion 285 may be formed of substantially rigid material (e.g., inelastic, inflexible, and/or solid material similar to other disclosed material of cutting device 105 such as plastic, metal, and composite material disclosed herein) and provided as part of an insert assembly (e.g., as disclosed below in FIGS. 21-24). For example, protrusion 285 formed from substantially rigid material may act as a rocker as disclosed below. Also for example, protrusion 285 may be formed from substantially flexible material (e.g., elastic material, elastomeric material, natural rubber, synthetic rubber, thermoplastic elastomers, or any other suitable type of material having elastic properties). Cover member 115 may also include a protrusion 290 that may be disposed on an exterior surface of cover member 115. Protrusion 290 may help a user of cutting device 105 to determine whether cover member 115 is in a locked or unlocked position as described further below (e.g., based on a movement of cover member 115 such as rotation relative to body assembly 110). Cover member 115 may also have an indicator 295 that may indicate to a user of cutting device 105 that cover member 115 may be rotated during the operation of cutting device 105 as described further below.

As illustrated in FIGS. 11-13, protrusion 285 of cover member 115 may be received in recess 185 of body member 120. As described further below, protrusion 285 may be moved within recess 185 based on a movement of cover member 115 by a user of cutting device 105. As illustrated in FIG. 12 (a section view 12-12 taken through the illustration of FIG. 11), protrusion 285 may be moved over (e.g., urged against and/or over) protrusion 205 (e.g., or protrusion 210) disposed in recess 185. For example, when a user moves and/or rotates cover member 115, protrusion 285 may be urged against and/or over surfaces 215 and 220 and portion 225 (e.g., a crown of protrusion 205 or 210). As described further below, moving protrusion 285 of cover member 115 over protrusion 205 disposed in recess 185 may serve to lock and/or unlock cover member 115 on cutting device 105.

As illustrated in FIGS. 10 and 14-16, the exemplary cutting device may include recesses that provide for locking of the cutting device by twisting of an exemplary cover member. For example, the exemplary cutting device may be a mechanism that twists to lock (e.g., the cover member is twisted to lock the cutting device). As illustrated in the exemplary embodiments of FIGS. 10 and 14-16, recesses may be configured with a bend at one or both of the end portions of the recess to provide one or a plurality of locking positions (e.g., two or more than two locking positions). For example, a recess may be "U" shaped, "Z" shaped, or any other suitable shape (e.g., in a view onto the top of the surface of the body member). For example, bends may be configured in a same or in an opposite direction relative to each other. For example, bends in the exemplary recesses may have angles at about 90° in the same direction ("U"), or in opposite directions ("Z"). Other steeper or less steep bend angles may be used such as, for example, between 45° and 135°, between 30° and 150°, or less steep angles such as, for example, between about 45° and 55°, between about 55° and 65°, between about 65° and 75°, between about 75° and 90°, between about 90° and 105°, between about 105 and 115°, between about 115 and 125°, and/or between about 125° and 135°.

Figure 14:
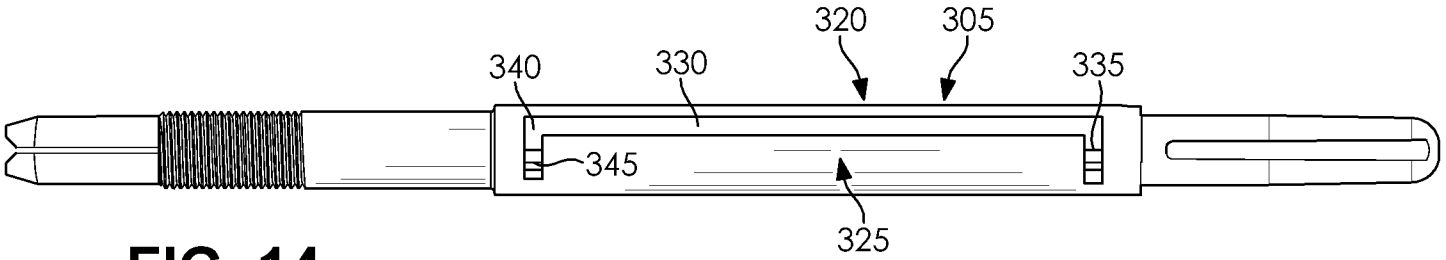
FIG. 14 is a side view of an exemplary cutting device in accordance with an embodiment of the present invention.

For example, FIG. 14 illustrates an exemplary cutting device 305 that may include a body member 320 as well as other components similar to cutting device 105. Body member 320 may include a recess 325 including a portion 330 extending in a longitudinal direction of cutting device 305 and portions 335 and 340 that may extend substantially perpendicularly (e.g., or at any suitable angle as disclosed above) to portion 330. Protrusions 345 may be disposed in any suitable portion of recess 325.

Figure 15:
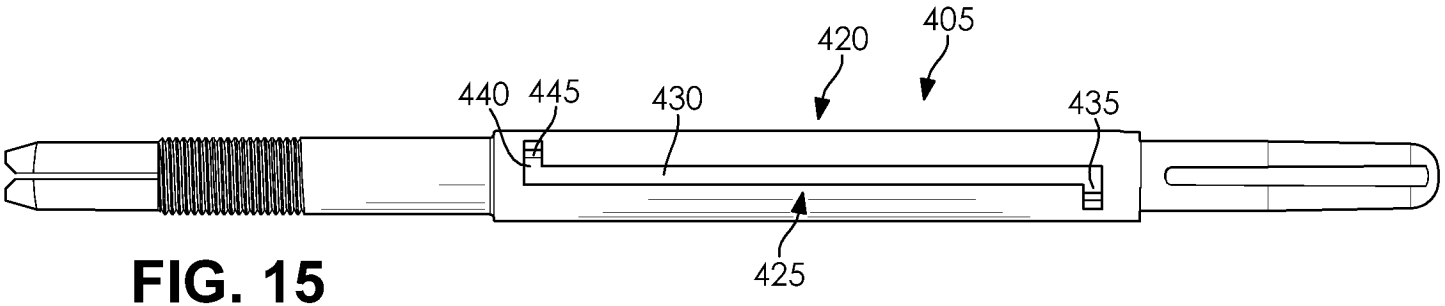
FIG. 15 is a side view of an exemplary cutting device in accordance with an embodiment of the present invention.

Also for example, FIG. 15 illustrates an exemplary cutting device 405 that may include a body member 420 as well as other components similar to cutting device 105. Body member 420 may include a recess 425 including a portion 430 extending in a longitudinal direction of cutting device 405 and portions 435 and 440 that may extend substantially perpendicularly (e.g., or at any suitable angle as disclosed above) to portion 430. Also for example, portions 435 and 440 may extend in substantially opposite direction to each other. Protrusions 445 may be disposed in any suitable portion of recess 425.

Figure 16:
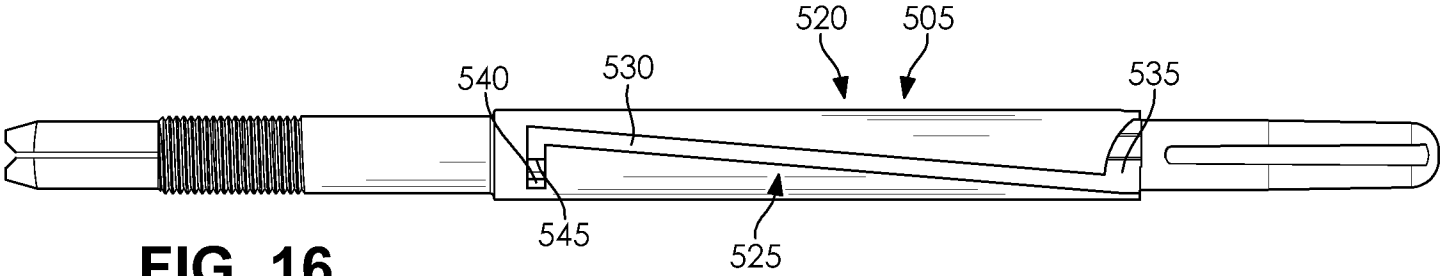
FIG. 16 is a side view of an exemplary cutting device in accordance with an embodiment of the present invention.

Also for example, FIG. 16 illustrates an exemplary cutting device 505 that may include a body member 520 as well as other components similar to cutting device 105. Body member 520 may include a recess 525 including a portion 530 extending at an angle (e.g., any suitable angle as disclosed above) relative to a longitudinal direction of cutting device 505 and portions 535 and 540 that may extend at any suitable angle as disclosed above to portion 530. Also for example, portions 535 and 540 may extend in substantially opposite direction to each other. Protrusions 545 may be disposed in any suitable portion of recess 525.

Figure 17:
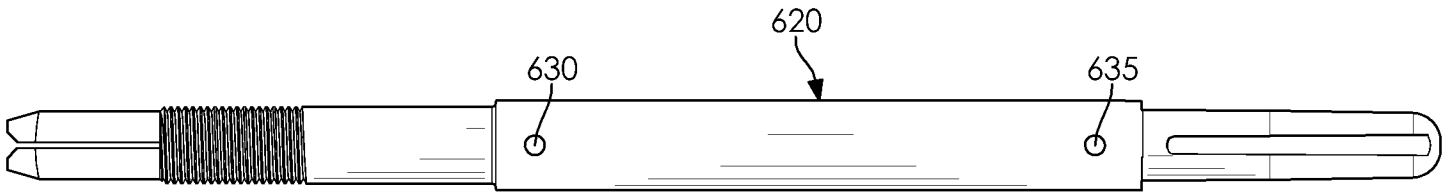
FIG. 17 is a side view of an exemplary cutting device in accordance with an embodiment of the present invention.

Also as for example as illustrated in FIG. 17, an exemplary body member 620 may be configured with a plurality of apertures 630 and 635 (e.g., locking holes) for example at a first position and a second position (e.g., first and second locking positions of an exemplary cover member that may be similar to cover member 115). For example, an exemplary cover member may be configured for locking and unlocking based on a user manually applying inward pressure (towards the center of body member 620, e.g., perpendicular to an outer surface of body member 620) to lock a protrusion (e.g., a protrusion similar to protrusion 285) selectively in apertures 630 and 635, and to unlock the exemplary protrusion (e.g., locking member) of the exemplary cover member by pushing the cover member (e.g. similar to cover member 115) in an upwards or downwards direction along a longitudinal axis of body member 620 (e.g., so that the protrusion is pulled out of aperture 630 or 635, either upwards and/or sideways, to be unlocked). For example, the exemplary protrusion (e.g., similar to protrusion 285 of cutting device 105) may be formed from a flexible material as disclosed above. Also for example, the exemplary cover member and protrusion (e.g., similar to cover member 115 and protrusion 285) may be configured to provide movement away from a surface of body member 620. For example, an exemplary body assembly may include a first recess (e.g., aperture 630) disposed on a first half of the body member and a second recess (e.g., aperture 635) disposed on a second half of the body member, the first and second recesses each configured to receive an exemplary protrusion (e.g., similar to protrusion 285 or any other suitable exemplary protrusion disclosed herein). Also for example, an exemplary cover member (e.g., similar to cover member 115) may cover the exemplary cutting member when the exemplary protrusion is received in the first recess (e.g., aperture 630), and the exemplary cover member may uncover the exemplary cutting member when the exemplary protrusion is received in the second recess (e.g., aperture 635).

Figure 18:
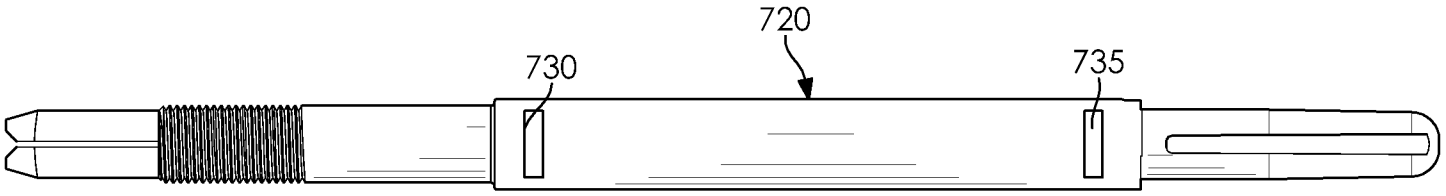
FIG. 18 is a side view of an exemplary cutting device in accordance with an embodiment of the present invention.

Further for example as illustrated in FIG. 18, an exemplary body member 720 (e.g., which may be similar to body member 620) may have apertures 730 and 735 that may be elongated recesses. Apertures 730 and 735 may include protrusions that may be similar to protrusions 205 and 210 of cutting device 105.

Figure 19:
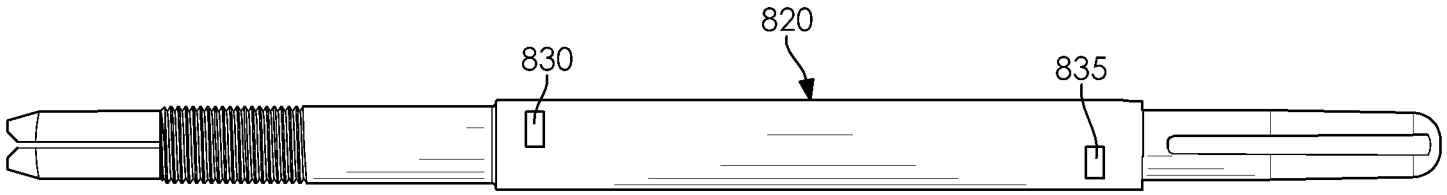
FIG. 19 is a side view of an exemplary cutting device in accordance with an embodiment of the present invention.

Further for example as illustrated in FIG. 19, an exemplary body member 820 (e.g., which may be similar to body member 620) may have apertures 830 and 835 that may be elongated recesses that extend in opposite directions from each other. Apertures 830 and 835 may include protrusions that may be similar to protrusions 205 and 210 of cutting device 105.

Figure 20:
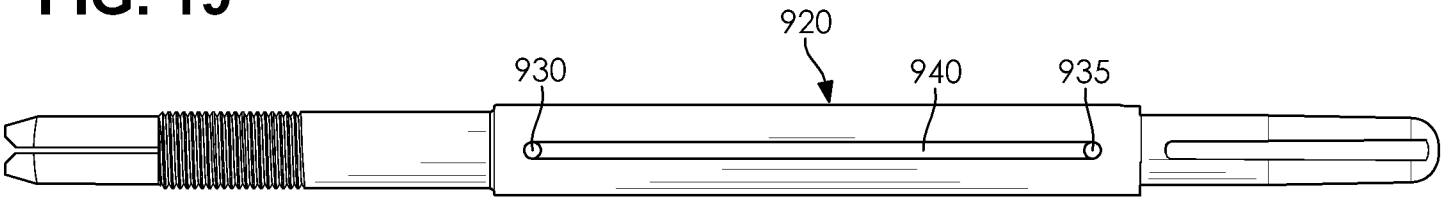
FIG. 20 is a side view of an exemplary cutting device in accordance with an embodiment of the present invention.

FIG. 20 illustrates an exemplary body member 920 that may be similar to body member 620. Body member 920 may include a plurality of apertures 930 and 935 (e.g., locking holes) for example at a first position and a second position. Body member 920 may also include a recess 940 that may extend between apertures 930 and 935 (e.g., first and second locking positions of an exemplary locking member that may be similar to locking member 115) and may serve as a slider mechanism. Recess 940 may be similar to portion 190 of cutting device 105 and may guide a movement of an exemplary protrusion that may be similar to protrusion 285 of cutting device 105. For example, recess 940 may guide a movement of the exemplary protrusion (e.g., similar to protrusion 285) so that the exemplary protrusion is not completely disengaged (e.g., pulled out of) recess 940 and apertures 930 and 935. The exemplary protrusion may be locked at either apertures 930 or 935 by friction, e.g., without twisting or rotation of an exemplary cover member. For example, a steepness of a surface of recess 940, surface materials of body member 920, surface materials of the exemplary protrusion received in recess 940 and apertures 930 and 935, and/or the dimensions of recess 940 and the exemplary protrusion (e.g., a protrusion similar to protrusion 285) may be configured to provide sufficient friction to allow a secure frictional attachment (e.g., frictional lock) at the first and second locking positions (e.g., at apertures 930 and 935).

Also for example, the exemplary protrusion of the embodiment illustrated in FIG. 19 may be a (e.g., spring-loaded) protrusion that is urged by a spring or similar urging member toward body member 920. A depth of apertures 930 and 935 may be greater than a depth of recess 940. For example, the protrusion may be urged (e.g., by the spring-loading) into the relatively greater depth of apertures 930 and 935 so that the exemplary protrusion is selectively retained in apertures 930 or 935 (e.g., apertures 930 and 935 serve as relatively deeper pockets for locking the exemplary protrusion and cover member in place). Also for example, when a user pushes on the exemplary cover member, the exemplary protrusion may be urged out of apertures 930 or 935 to unlock the cover member and allow a movement of the cover member based on a movement of the exemplary protrusion being moved along recess 940 (e.g., that may be relatively shallower than apertures 930 and 935).

Figure 22:
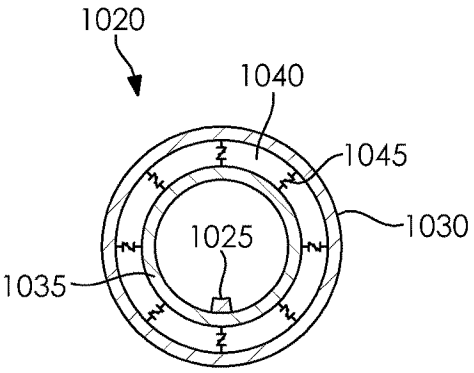
FIG. 22 is a sectional view of an exemplary cutting device in accordance with an embodiment of the present invention.
Figure 21:
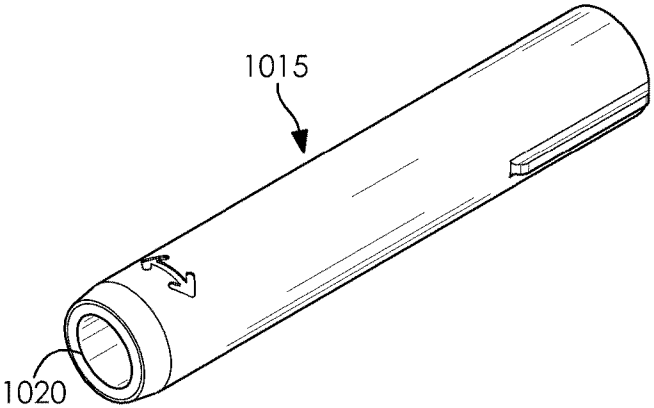
FIG. 21 is a perspective view of an exemplary cutting device in accordance with an embodiment of the present invention.

FIGS. 21 and 22 illustrate an additional exemplary embodiment including a cover member 1015. Cover member 1015 may include a member 1020 that may be for example an insert piece that may be removably attachable or attached in a fixed manner to an interior surface of cover member 1015. Member 1020 may include a protrusion 1025 that may be similar to protrusion 285 of cover member. Member 1020 may include an exterior member 1030 and an interior member 1035 that may be formed for example from similar material to cover member 115. A cavity 1040 may be disposed between and formed by exterior member 1030 and interior member 1035. One or more urging members 1045 may be disposed within cavity 1040 and may be attached to members 1030 and 1035. Urging member 1045 may be a potential-energy-storing member that can be stretched and unstretched and/or compressed and uncompressed such as, for example, a tension member and/or a compression member. For example, urging member 1045 may be a spring, an elastic member such as an elastic band, an elastic cable, an elastic wire, and/or any suitable member formed from materials having elastic or resilient properties and capable of being stretched and unstretched (e.g., or compressed and uncompressed). Urging member 1045 may be formed from any suitable materials for forming a tension member or a compression member (e.g., that can be stretched and unstretched, or compressed and uncompressed) such as metallic material, plastic material, composite material, elastomeric material, natural rubber, and/or synthetic rubber.

Figure 24:
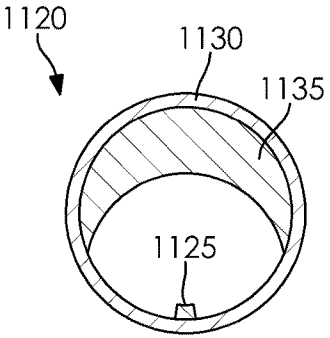
FIG. 24 is a sectional view of an exemplary cutting device in accordance with an embodiment of the present invention.
Figure 23:
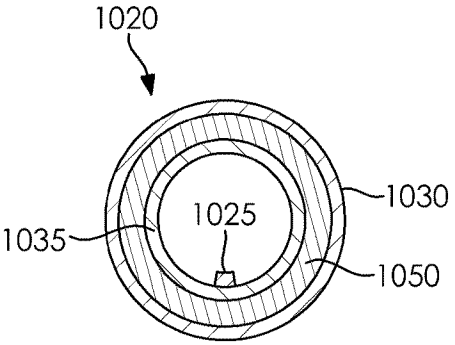
FIG. 23 is a sectional view of an exemplary cutting device in accordance with an embodiment of the present invention.

For example, protrusion 1025 may be received in an exemplary recess similar to recesses 185, 325, 425, 525, 630, 635, 730, 735, 830, 835, 930, and/or 935. Protrusion 1025 may be disengaged from the exemplary recess by applying pressure (e.g., sideways pressure or lateral pressure that is applied radially to protrusion 1025) when sliding cover member 1015 between exemplary positions as disclosed for example herein. Also for example, protrusion 1025 may be locked at an exemplary position (e.g., a first locked position or a second locked position), but may be disengaged from an exemplary recess based on applying lateral pressure to member 1020. For example, lateral pressure may cause urging members 1045 on one side of cavity 1040 to compress and may cause urging members on another (e.g., opposite) side of cavity 1040 to elongate, causing a displacement (e.g., shifting) of cover member 1015 relative to an exemplary body assembly similar to body assembly 110. Also for example, the plurality of urging members 1045 may press protrusion 1025 towards an exemplary body assembly with sufficient force to cause protrusion 1025 to engage with an exemplary recess (e.g., recess 185, 325, 425, 525, 630, 635, 730, 735, 830, 835, 930, and/or 935) to lock cover member 1015 into position. Also for example, the plurality of urging members 1045 may be flexible enough to allow protrusion 1025 to disengage and slide out of the exemplary recess as a user applies lateral pressure when for example sliding cover member 1015 between desired positions. The above-disclosed operation may be performed by any suitable configuration of an exemplary cover member such as, for example, a cover member including an insert piece having a rocker, small bent thin metal rod, and/or compressible or flexible materials. For example, any suitable configuration may be used that directs suitable force to protrusion 1025 to lock the exemplary protrusion into an exemplary recess, but allows a lateral force to be applied to the exemplary protrusion when sliding the exemplary cover member (e.g., perpendicular for example at about a 90° angle to the longitudinal axis of the exemplary protrusion such as protrusion 1025), to allow the exemplary protrusion to slide out of the exemplary recess and to unlock. For example, FIGS. 23 and 24 illustrate additional embodiments of exemplary members that may operate generally similarly to member 1020. For example as illustrated in FIG. 23, a flexible or compressible material 1050 may be disposed between members 1030 and 1035 that may operate similarly to one or more urging members 1045. Flexible or compressible material 1050 may be any suitable material having elastic or resilient properties and capable of being stretched and unstretched (e.g., or compressed and uncompressed) such as, for example, elastomeric material, natural rubber, and/or synthetic rubber. FIG. 24 illustrates an additional exemplary embodiment including a member 1120 having a protrusion 1125 and a member 1130. As illustrated in FIG. 24, flexible or compressible material 1135 that may be similar to material 1050 may be disposed (e.g., attached to) one side of member 1130 and may provide a similar operation as the exemplary embodiments disclosed above (e.g., may allow a displacement or movement of an exemplary cover member when lateral pressure is applied, thereby allow protrusion 1125 to be removably received in an exemplary recess). For example, members 1030 and/or 1035, urging members 1045, and/or material 1050 and/or 1135 may provide a flexible member for example that is disposed on an interior surface of the exemplary cover member, wherein an exemplary protrusion is disposed on either the flexible member or an interior surface of the exemplary cover member.

The exemplary cutting device may include a balancing weight configured within the body assembly of the cutting device. For example, the cutting device may be configured to retain a weight within a hollow cavity of the body assembly of the cutting device. For example, when the weight is placed inside the body assembly, the weight may be secured in such a manner as hold the weight in place (e.g., using a compression fit within an inner wall of the body and/or with use of adhesive). For example, the weight may be placed at an opposite end of the exemplary cutting member, thereby adding balance to the cutting device, helping a user to better control a cutting end of the cutting device, and/or improving the safety of the craft knife.

Many suitable methods and corresponding materials may be used to manufacture the exemplary cutting device. For example, the cutting device may be formed by 3D printing (also known as "additive" manufacturing), CNC machined parts (also known as "subtractive" manufacturing) and injection molding. Also for example, thermoplastic and thermosetting polymers and resins and elastomers, including e.g. polyethylene, polystyrene, polypropylene, epoxy resins and phenolic resins may be used in manufacturing the cutting device. Any suitable plastics, polymers, and resins may be selected and mixed (e.g., depending on desired strength and flexibility) for use in manufacturing. Examples of suitable thermoplastic materials for use in manufacturing of the exemplary cutting device may include, for example, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), Engineered Thermoplastic Polyurethane (ETPU), or any suitable combination thereof.

The exemplary disclosed device and method may provide an intuitively simple and safe technique for covering and uncovering a cutting member. The exemplary disclosed device and method may be used in any application involving maintaining a cover for covering a cutting device and avoiding loss of a cover for a cutting member (e.g., avoiding a situation in which a separate cover for a cutting device is lost or separated). For example, the exemplary cutting device and method may be used in applications such as pen cutters, seam rippers, box cutters, utility knives, precision knives, and any other suitable application for cutting materials.

An exemplary operation of cutting device 105 will now be described. As illustrated in FIG. 3, cover member 115 may be disposed in a first position covering cutting member 125. The first position may be a first locked position in which protrusion 285 is disposed in portion 195 of recess 185. For example, protrusion 285 may be disposed at an end portion of portion 195 that is distal from portion 190 so that protrusion 205 is disposed between protrusion 285 and an end portion of portion 195 adjacent to portion 190. Cover member 115 may be thereby locked into position based on a movement of protrusion 285 of cover member 115 being blocked (e.g., initially resisted by) protrusion 205.

A user may move cover member 115 in a first direction (e.g., a longitudinal direction of cutting device 105) and a second direction (e.g., radially about cutting device 105 and/or different from or substantially perpendicular to the first direction). For example, the user may lock and/or unlock the cover member as disclosed herein by moving (e.g., rotating) cover member 115 in the second direction. A user may move (e.g., rotate) cover member 115 relative to body assembly 110 to unlock cover member 115 from the first position. The user may rotate cover member 115 in a radial direction (e.g., perpendicular to the longitudinal direction of cutting member 105 and body assembly 110) to move protrusion 285 within portion 195 of recess 185 and over protrusion 205. For example, by rotating cover member 115, protrusion 285 may be urged over the exemplary two-sided ramp (e.g., and crown) of protrusion 205 as disclosed above. For example, cover member 115 may be moved in the second direction (e.g., radial, rotational direction, and/or direction different from or substantially perpendicular to a first direction that may be a longitudinal direction of cutting device 105) to move protrusion 285 over protrusion 205 (e.g., similar to moving over protrusion 210). After the user urges protrusion 285 over protrusion 205, protrusion 285 may be positioned to move freely along a remainder of portion 195 and into portion 190 of recess 185. Also for example as disclosed herein in other exemplary embodiments, cover member 115 may be locked and unlocked in any other suitable manner (e.g., as disclosed regarding FIGS. 17-24). The user may continue to rotate cover member 115 until protrusion 285 is disposed at a portion of recess 185 at which portion 195 meets with or connects to portion 190. At this point, the user may then move cover member 115 in a substantially longitudinal direction along recess 190 (e.g., or in the case of other exemplary embodiments along recess 330, 430, 530, and/or 940).

When protrusion 285 has been moved to a location of recess 185 where portion 190 meets with (e.g., is connected to) portion 200, the user stops moving cover member 115 longitudinally along cutting device 105 (e.g., the user will feel that movement is no longer available further in the longitudinal direction based on protrusion 285 reaching an end of portion 190). The user may then rotate cover member 115 in a radial direction to move protrusion 285 along portion 200. In some exemplary embodiments the direction of rotation may be opposite (e.g., as illustrated in FIGS. 10 and 14) to unlocking and locking at the first position covering cutting member 125 and in some exemplary embodiments the direction of rotation at or near both of the first and second positions may be substantially the same (e.g., as illustrated in FIGS. 15 and 16). Rotation of cover member 115 may be, for example, clockwise and/or counterclockwise rotation relative to a user's manipulation of cutting device 105. The user may move (e.g., rotate) cover member 115 so that protrusion 285 is urged over protrusion 210 disposed in portion 200 of recess 185. Cover member 115 may be locked in a second position uncovering cutting member 125 when protrusion 285 is disposed in an end portion of portion 200 that is distal from portion 190 (e.g., a position in which protrusion 210 is disposed between protrusion 285 and a location of portion 200 that meets portion 190). When cover member 115 is locked in the second position uncovering cutting member 125, a user may utilize cutting device 105 to cut material using cutting member 125. A user may also for example replace a used cutting member 125 with a new cutting member 125 by detaching and replacing cutting members to attachment portion 140.

For example, cover member 115 may be locked in the first position (e.g., covering cutting member 125) when protrusion 285 is disposed at an end portion of the second portion (e.g., portion 195) of recess 185 that is distal from the first portion (e.g., portion 190) of recess 185. Also for example, cover member 115 may be locked in the second position (e.g., uncovering cutting member 125) when protrusion 285 is disposed at an end portion of the third portion (e.g., portion 200) of the recess that is distal from the first portion (e.g., portion 190) of recess 185.

When a user has finished using cutting device 105, the user may close cutting device 105 (e.g., cover cutting member 125 with cover member 115) by reversing the steps disclosed above. For example, a user may unlock locking member 115 by urging protrusion 285 over protrusion 210, moving protrusion 285 along a remainder of portion 200 (e.g., by rotating cover member 115), moving protrusion 285 along a length of portion 190 (e.g., or other exemplary portions such as portions 330, 430, 530, and/or 940; for example by moving cover member 115 along a substantially longitudinal direction of cutting device 105), and then moving protrusion 285 within portion 195 and over protrusion 205 to lock cover member 115 into place in the first position covering cutting member 125. For example, when cover member 115 is in the first position (e.g., first locked position) covering cutting member 125, cutting device 105 may be in a suitable configuration for storage and/or for the user to carry (e.g., without concern regarding unintentional cutting by the exemplary cutting device).

The exemplary disclosed cutting device and method may provide an intuitively simple device and technique for safely and easily using a cutting device such as a pen cutter. For example, the exemplary device and method may provide a technique for covering a cutting member without using a separate cap that may become lost. Also, the exemplary device and method may provide a technique for quickly and easily covering a cutting member as desired during use. For example, the exemplary device may include a cap that may not become separated and may avoid the continued use of a cutting device that is missing a cap. For example, the use of a cutting device such as a pen cutter with an exposed blade is avoided, thereby decreasing the probability of accidental cuts and injuries to people, materials, and objects.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a body member;

a cutting member that is removably attachable to the body member; and a cover member that is movably disposed on the body member, the cover member including a protrusion;

wherein the body member includes a recess configured to receive the protrusion;

wherein the recess includes a first portion extending in a first direction and a second portion extending in a second direction that is different from the first direction; and wherein the second portion of the recess includes a protrusion disposed at a central portion of the second portion of the recess.

2. The cutting device of claim 1, wherein the cover member is movably disposed on the body member between a first position covering the cutting member and a second position uncovering the cutting member.

3. The cutting device of claim 2, wherein the recess includes a third portion extending in the second direction, wherein the first portion is disposed between the second portion and the third portion.

4. The cutting device of claim 3, wherein the cover member is locked in the second position when the protrusion of the cover member is disposed at an end portion of the third portion of the recess that is distal from the first portion of the recess.

5. The cutting device of claim 2, wherein the cover member is locked in the first position when the protrusion of the cover member is disposed at an end portion of the second portion of the recess that is distal from the first portion of the recess.

6. The cutting device of claim 1, wherein the first direction is substantially perpendicular to the second direction.

7. The cutting device of claim 1, wherein the first direction is a longitudinal direction extending along a length of the cutting device.

8. The cutting device of claim 1, wherein the second direction is a radial direction extending radially about a longitudinal centerline of the cutting device.

9. The cutting device of claim 1, wherein the cutting member is formed from ceramic material.

10. A method, comprising:

removably attaching a cutting member to a body member;

moving a cover member in a first direction along a length of the body member between a first position covering the cutting member and a second position uncovering the cutting member, providing the cover member with a protrusion; and moving the cover member in a second direction that is different from the first direction at the first position or the second position to lock/unlock the cover member;

providing the body member with a recess configured to receive the protrusion of the cover member, the recess including a first portion extending in the first direction and a second portion extending in the second direction;

providing the second portion of the recess with a protrusion and moving the protrusion of the cover member over the protrusion of the second portion of the recess to lock/unlock the cover member.

11. The method of claim 10, wherein the protrusion of the second portion of the recess is disposed at a central portion of the second portion.

12. The method of claim 10, further comprising locking or unlocking the cover member at the first position covering the cutting member by moving the cover member in the second direction.

13. The method of claim 10, further comprising locking or unlocking the cover member at the second position uncovering the cutting member by moving the cover member in the second direction.

14. The method of claim 10, further comprising encircling a portion of the body member with the cover member.

* * * * *